US008100658B2

(12) United States Patent
Iida et al.

(10) Patent No.: US 8,100,658 B2
(45) Date of Patent: Jan. 24, 2012

(54) AXIAL-FLOW FLUID MACHINE BLADE

(75) Inventors: Koichiro Iida, Hyogo (JP); Junji Iwatani, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 819 days.

(21) Appl. No.: 12/223,337

(22) PCT Filed: Jan. 30, 2007

(86) PCT No.: PCT/JP2007/051436
§ 371 (c)(1),
(2), (4) Date: Jul. 29, 2008

(87) PCT Pub. No.: WO2007/105380
PCT Pub. Date: Sep. 20, 2007

(65) Prior Publication Data

US 2009/0169391 A1 Jul. 2, 2009

(30) Foreign Application Priority Data

Mar. 14, 2006 (JP) ..... 2006-069135

(51) Int. Cl.
*B63H 1/26* (2006.01)

(52) U.S. Cl. ..... 416/223 R; 416/228; 416/241 R

(58) Field of Classification Search ..... 416/223 R, 416/228, 241 R
See application file for complete search history.

(56) References Cited

U.S. PATENT DOCUMENTS

| | | | | |
|---|---|---|---|---|
| 4,995,787 | A * | 2/1991 | O'Connor | 416/228 |
| 5,706,647 | A | 1/1998 | Frey et al. | |
| 5,961,289 | A * | 10/1999 | Lohmann | 416/189 |
| 6,749,401 | B2 * | 6/2004 | Vanmoor | 416/228 |
| 2008/0107538 | A1 * | 5/2008 | Bois et al. | 416/223 A |

FOREIGN PATENT DOCUMENTS

| | | | |
|---|---|---|---|
| JP | 36-1159 | B1 | 3/1961 |
| JP | 36-15301 | B1 | 9/1961 |
| JP | 52-64008 | A | 5/1977 |
| JP | 9-507896 | A | 8/1997 |
| JP | 10-103002 | A | 4/1998 |
| JP | 10-184303 | A | 7/1998 |
| JP | 2000-145402 | A | 5/2000 |
| JP | 2004-028065 | A | 1/2004 |
| JP | 3559152 | B2 | 5/2004 |
| JP | 2006-291889 | A | 10/2006 |

OTHER PUBLICATIONS

Simon J. Gallimore et al.; "The use of sweep and dihedral in multi-stage axial flow compressor blading—Part II: Low and high speed designs and test verification"; Proceedings of ASME Turbo Expo 2002, Jun. 3-6, 2002, Amsterdam, The Netherlands.

International Search Report of PCT/JP2007/051436, date of mailing Apr. 10, 2007.

* cited by examiner

*Primary Examiner* — Michelle Estrada
(74) *Attorney, Agent, or Firm* — Westerman, Hattori, Daniels & Adrian, LLP

(57) ABSTRACT

An axial-flow fluid machine blade which achieves reduction of the frictional loss of the blade and provision of a high surge-resistant property is provided. An axial-flow fluid machine blade 60 used for an axial-flow fluid machine includes a leading edge 61 projecting at the tip portion and the root portion thereof toward the upstream side and a trailing edge 62 projecting at the tip portion, the mid-span portion and the root portion thereof toward the downstream side.

6 Claims, 5 Drawing Sheets

AXIAL-FLOW FLUID MACHINE BLADE

TECHNICAL FIELD

The present invention relates to a blade (for example, a stator blade) used for an axial-flow fluid machine (for example, an axial-flow compressor or the like).

BACKGROUND ART

As blades used for an axial-flow fluid machine, those disclosed in, for example, Patent Documents 1, 2 are known.

Patent Document 1: Japanese Unexamined Patent Application Publication No. 10-103002

Patent Document 2: Japanese Unexamined Patent Application Publication No. 10-184303

DISCLOSURE OF INVENTION

A blade disclosed in Patent Document 1 has a leading edge having substantially a U-shape in plan view in which the tip portion and the root portion at the leading edge thereof project toward the upstream side.

A blade disclosed in Patent Document 2 has a trailing edge having substantially U-shape in plan view in which the tip portion and the root portion at the trailing edge thereof project toward the downstream side.

In order to reduce the frictional loss of the blade and improve the performance of the axial-flow fluid machine, it is contemplated to combine the invention in the Patent Document 1 and the invention in the Patent Document 2 to reduce the surface area of the entire blade, so that the frictional loss of the blade is significantly reduced and hence the performance of the axial-flow fluid machine is improved.

However, with the blade obtained by combining the blade disclosed in Patent Document 1 and the blade disclosed in Patent Document 2, the chord length at a mid-span portion becomes shorter than the chord length of other portions. Therefore, while the frictional loss of the blade is reduced at the rated point and hence the performance of the axial-flow fluid machine is improved, for example, when the working point is moved to the side having a higher pressure ratio than the rated point when the load is high, there arises a problem such that the air flow is separated at the mid-span portion, and hence a surge is generated.

In view of such circumstances, it is an object of the present invention to provide an axial-flow fluid machine blade which achieves reduction of the frictional loss and provision of a high surge-resistant property.

In order to solve the problem described above, the following solutions are employed in the present invention.

An axial-flow fluid machine blade according to the present invention is an axial-flow fluid machine blade used for an axial-flow fluid machine having a leading edge projecting at the tip portion and the root portion thereof toward the upstream side and a trailing edge projecting at the tip portion, the mid-span portion and the root portion thereof toward the downstream side.

With the axial-flow fluid machine blade as described above, the leading edge is formed to assume a substantially U-shape in plan view, and the trailing edge is formed to assume a substantially W-shape in plan view, so that the chord length of the entire blade is reduced, and the surface area of the entire blade is reduced. Accordingly, the frictional loss of the blade is reduced.

The chord lengths of the blade, in particular, between the tip portion and the mid-span portion, and between the mid-span portion and the root portion are reduced, and hence the surface areas of these areas are reduced, so that the frictional loss in these areas is reduced, for example, as shown by a broken line in FIG. 4.

Furthermore, since the blade is formed in such a manner that the chord length of the mid-span area is longer than the chord length of the area between the tip portion and the mid-span portion and the area between the mid-span portion and the root portion (for example, so as to have the same chord length as the chord length at 0% Ht and the chord length at 100% Ht), even when the working point is moved to the side having a higher pressure ratio than the rated point when the load is high, the separation of the air flow at the mid-span portion is prevented, and the lowering of the surge resistance may be prevented.

Furthermore, since the blade is manufactured by paring the leading edge and the trailing edge (that is, it is not manufactured so as to add the tip portion, the mid-span portion and the root portion on the upstream side and/or the downstream side), upsizing in the axial direction can be avoided.

An axial-flow fluid machine blade according to the present invention is an axial-flow fluid machine blade used for an axial-flow fluid machine having a leading edge projecting at the tip portion, the mid-span portion and the root portion thereof toward the upstream side and a trailing edge projecting at the tip portion and the root portion thereof toward the downstream side.

With the axial-flow fluid machine blade as described above, the leading edge is formed to assume a substantially W-shape in plan view, and the trailing edge is formed to assume a substantially U-shape in plan view, so that the chord length of the entire blade is reduced, and the surface area of the entire blade is reduced. Accordingly, the frictional loss of the blade is reduced.

The chord lengths of the blade, in particular, between the tip portion and the mid-span portion, and between the mid-span portion and the root portion are reduced, and hence the surface areas of these areas are reduced, so that the frictional loss in these areas is reduced, for example, as shown by a broken line in FIG. 4.

Furthermore, since the blade is formed in such a manner that the chord length of the mid-span area is longer than the chord length of the area between the tip portion and the mid-span portion and the area between the mid-span portion and the root portion (for example, so as to have the same chord length as the chord length at 0% Ht and the chord length at 100% Ht), even when the working point is moved to the side having a higher pressure ratio than the rated point when the load is high, the separation of the air flow at the mid-span portion is prevented, and the lowering of the surge resistance may be prevented.

Furthermore, since the blade is manufactured by paring the leading edge and the trailing edge (that is, it is not manufactured so as to add the tip portion, the mid-span portion and the root portion on the upstream side and/or the downstream side), upsizing in the axial direction is avoided.

An axial-flow fluid machine blade according to the present invention is an axial-flow fluid machine blade used for an axial-flow fluid machine in which, assuming that the root is at 0% Ht (Ht is the blade height) and the tip is at 100% Ht, the chord length near a portion at 20% Ht and the chord length near a portion at 80% Ht are shorter than the chord length near a portion at 50% Ht.

With the axial-flow fluid machine blade as described above, the leading edge is formed to assume a substantially U-shape in plan view, and the trailing edge is formed to assume a substantially W-shape in plan view, so that the chord length of the entire blade is reduced, and the surface area of the entire blade is reduced. Accordingly, the frictional loss of the blade is reduced.

The cord lengths of the blade, in particular, near the portion at 20% Ht and near the portion at 80% Ht are reduced, and hence the surface areas of these areas are reduced, so that the frictional loss in these areas is reduced, for example, as shown by a broken line in FIG. 4.

Furthermore, since the blade is formed in such a manner that the chord length near the portion at 50% Ht is longer than the chord length near the portion at 20% Ht and the chord length near the portion at 80% Ht (for example, so as to have the same chord length as the chord length at 0% Ht and the chord length as 100% Ht), even when the working point is moved to the side having a higher pressure ratio than the rated point when the load is high, the separation of the air flow at the mid-span portion is prevented, and the lowering of the surge resistance may be prevented.

Further more, since the blade is manufactured by paring the leading edge and the trailing edge (that is, it is not manufactured so as to add the tip portion, the mid-span portion and the root portion on the upstream side and/or the downstream side), upsizing in the axial direction is avoided.

An axial-flow fluid machine according to the present invention is able to reduce the frictional loss of the blade and is provided with the axial-flow fluid machine blade having a high surge-resistant property.

According to the axial-flow fluid machine as described above, the performance is improved, and the surge margin is improved.

According to the present invention, the frictional loss is reduced and the lowering of the surge-resistant property is prevented.

EXPLANATION OF REFERENCE

Figure 1:
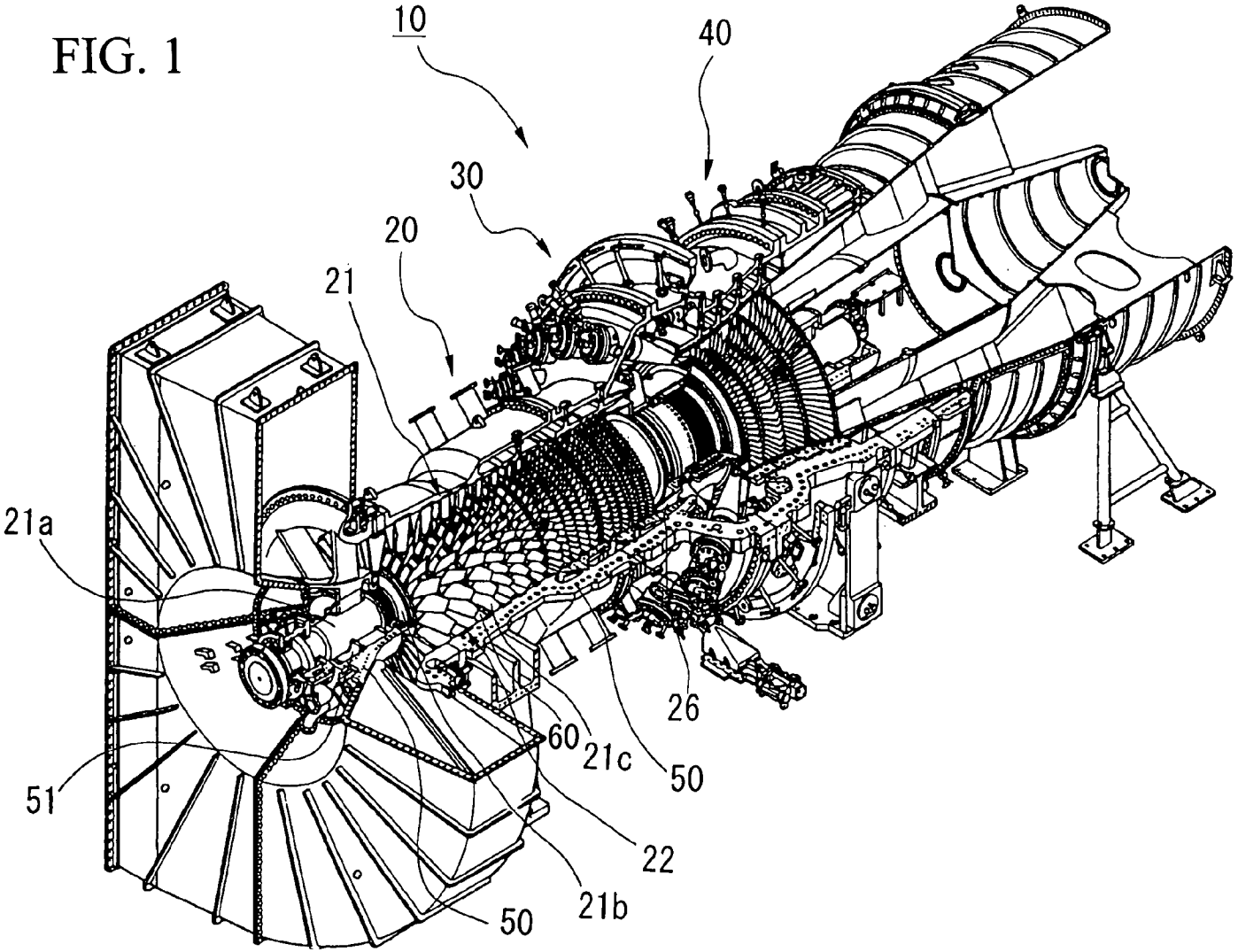
FIG. 1 is a schematic perspective view of a gas turbine having an axial-flow fluid machine blade according to the present invention, showing a state in which the upper half portion of a casing is removed.

20: compressing unit (axial-flow fluid machine)
60: stator blade (axial-flow fluid machine blade)
61: leading edge
62: trailing edge
70: stator blade (axial-flow fluid machine blade)
71: leading edge
72: trailing edge

BEST MODE FOR CARRYING OUT THE INVENTION

Referring now to the drawings, a first embodiment of an axial-flow fluid machine blade in the present invention will be described.

FIG. 1 is a schematic perspective view of a gas turbine 10 having an axial-flow fluid machine blade (hereinafter, referred to as "stator blade") 60 according to this embodiment, showing a state in which the upper half portion of a casing is removed.

As shown in FIG. 1, the gas turbine 10 includes a compressing unit (axial-flow fluid machine) 20 for compressing combustion air, a combustion unit 30 for combusting fuel injected into a high-pressure air fed from the compressing unit 20 and generating high-temperature combustion gas, and a turbine unit 40 positioned on the downstream side of the combustion unit 30 and driven by the combustion gas discharged out from the combustion unit 30 as main elements.

The compressing unit 20 includes a rotor assembly 21 and a stator blade assembly 22.

The rotor assembly 21 includes a shaft 21*a* arranged on a journal bearing 51 provided in a casing 50 and a plurality of rotor blade disks 21*b* provided on the shaft 21*a*. The rotor blade disks 21*b* each include a plurality of rotor blades 21*c*.

The stator blade assembly 22 is arranged adjacent to the rotor blade disks 21*b* in the axial direction, and is divided into a plurality of segments circumferentially of the casing 50 and, for example, the stator blade assembly 22 divided into two each segments in the upper half portion and the lower half portion of the casing 50 constitutes each stator portion with four segments (that is, four stator blade assemblies) as one stage of a stator portion.

Reference numeral 26 in FIG. 1 is a diffuser.

Figure 2:
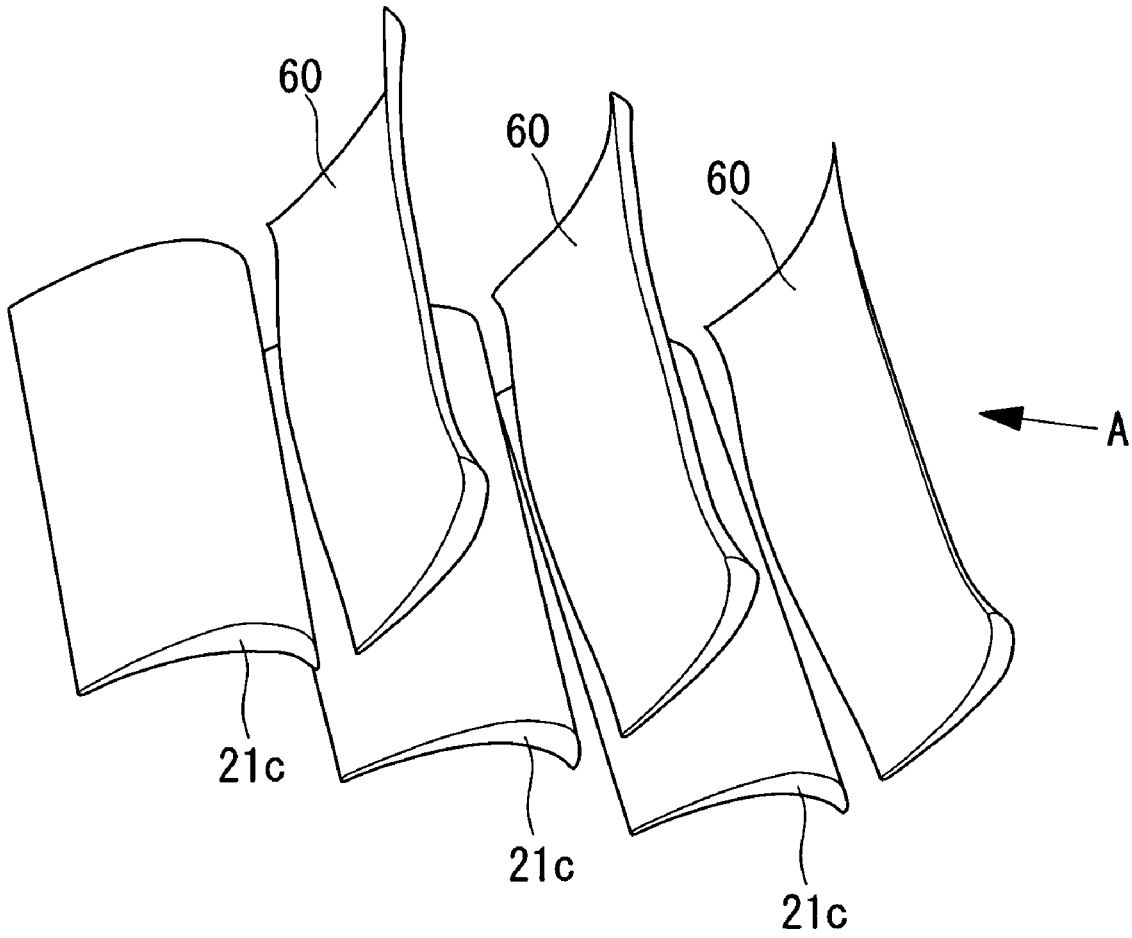
FIG. 2 is a perspective view of a principal portion of the axial-flow fluid machine blade shown in FIG. 1 and rotor blades positioned on the rear side thereof.

As shown in FIG. 1 and FIG. 2, the stator blade assembly 22 includes a plurality of stator blades 60 arranged in an annular shape, and introduces air flow to the rotor blades 21*c* (or the diffuser 26) positioned at the rear thereof.

Figure 3:
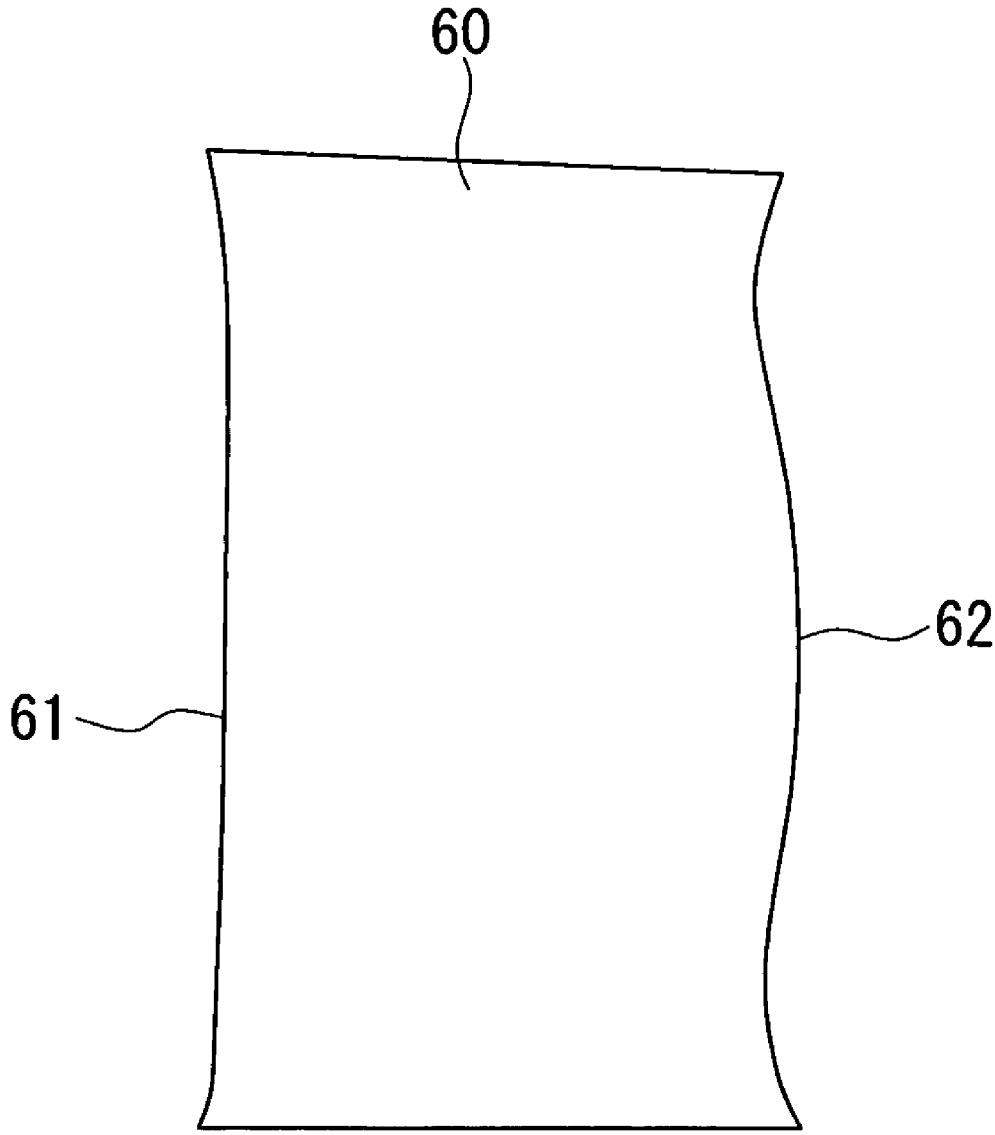
FIG. 3 is a plan view of the axial-flow fluid machine blade shown in FIG. 2 viewed along an arrow A shown in FIG. 2.

Subsequently, using FIG. 3, the stator blades 60 according to this embodiment will be described in detail. FIG. 3 is a plan view of the stator blade 60 viewed along an arrow A shown in FIG. 2, that is, a view showing an outline of the stator blade 60 placed on a flat desk with a ventral side faced down viewed from above.

In FIG. 3, the left side corresponds to the leading edge side, the right side corresponds to the trailing edge side, the upper side corresponds to the tip (distal end) side, and the lower side corresponds to the root (base) side.

As shown in FIG. 3, a leading edge 61 of the stator blade 60 is formed so as to assume a substantially U-shape in plan view in which the tip portion and the root portion project toward the upstream side (the upstream side with respect to the flow of combustion air). A trailing edge 62 of the stator blade 60 is formed so as to assume a substantially W-shape in plan view in which the tip portion, the mid-span portion and the root portion project toward the downstream side (the downstream side with respect to the flow of the combustion air). In other words, the stator blade 60 is manufactured in such a manner that the chord length near a portion at 20% Ht and the chord length near a portion at 80% Ht is shorter than the chord length near a portion at 50% Ht (in other words, in such a manner that the chord length near the portion at 20% Ht and the chord length near the portion at 80% Ht are minimized).

The chord length near the portion at 50% Ht is the same as the chord length near the portion at 0% Ht and the chord length near the portion at 100% Ht.

The portion at 0% Ht corresponds to the root of the stator blade 60 and the portion at 100% Ht corresponds to the distal end of the stator blade 60.

According to the stator blade 60 according to this embodiment, the leading edge 61 is formed so as to assume the substantially U-shape in plan view and the trailing edge 62 assumes the substantially W-shape in plan view, so that the chord length of the entire stator blade 60 is reduced and the surface area of the entire stator blade 60 is reduced. Accordingly, the frictional loss of the stator blade 60 is reduced.

Figure 4:
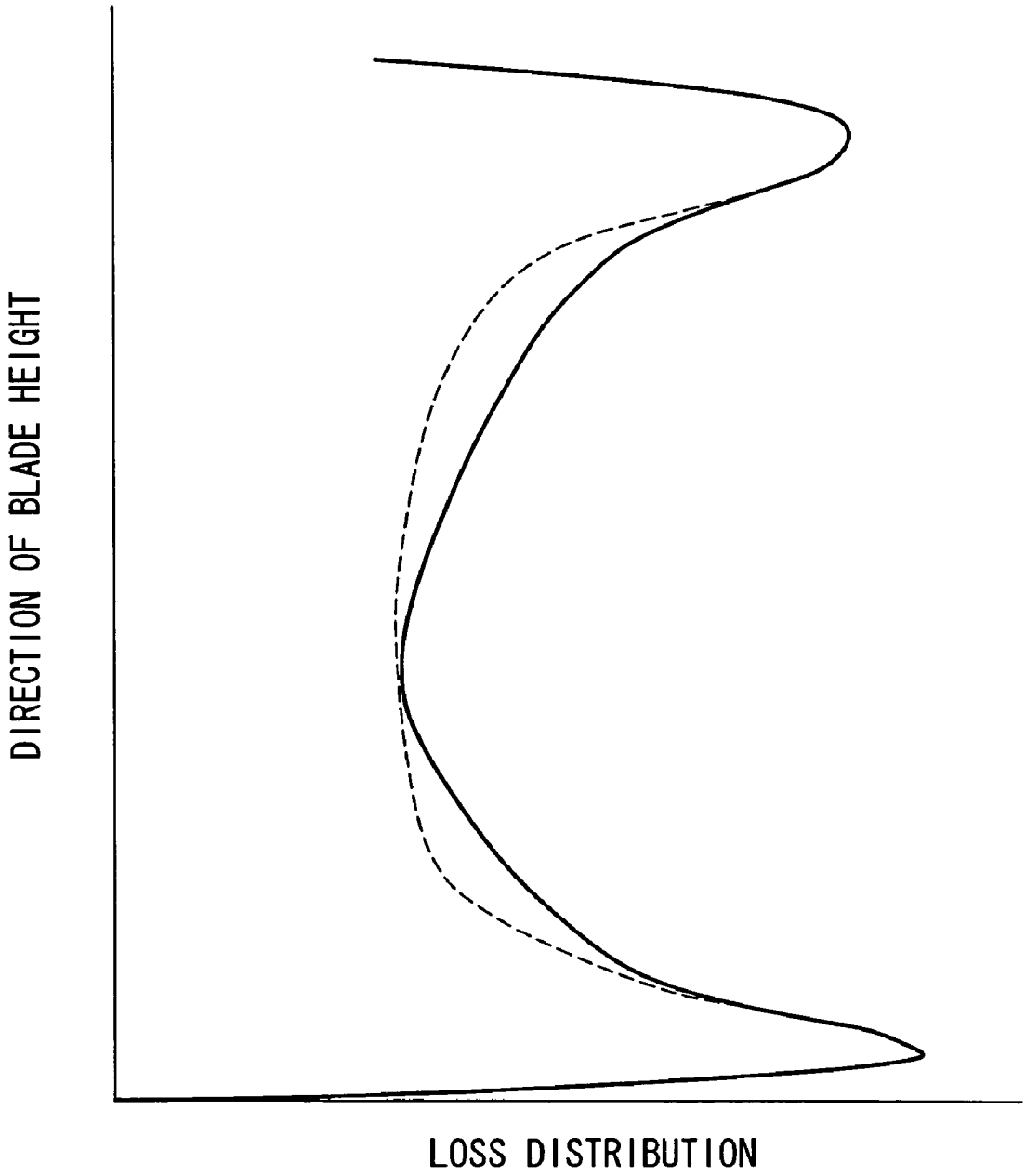
FIG. 4 is a graph of comparison between the frictional loss of the axial-flow fluid machine blade in the present invention and the frictional loss of the axial-flow fluid machine blade in the related art.

Since the chord lengths of the stator blade 60 between the chip portion and the mid-span portion and between the mid-span portion and the root portion are reduced, and the surface areas of these areas are reduced, so that the frictional loss in these areas is reduced as shown by the broken line in FIG. 4.

A thick solid line in FIG. 4 represents the stator blade having the leading edge 61 shown in FIG. 3 and the rear edge formed straight from the root to the tip (that is, no convex and concave is formed from the root to the tip).

The broken line in FIG. 4 represents the stator blade 60 manufactured in such a manner that the chord length near the portion at 25% Ht and the chord length near the portion at 75% Ht is shorter than the chord length near the portion at 50% Ht (in other words, in such a manner that the chord length near the portion at 25% Ht and the chord length near the portion at 75% Ht are minimized).

Since the stator blade 60 according to this embodiment is manufactured in such a manner that the chord length near the portion at 50% Ht (mid-span portion) is longer than the chord lengths between the tip portion and the mid-span portion and between the mid-span portion and the root portion (for example, in such a manner that the chord length at 0% Ht and the cord length at 100% Ht become substantially the same), even when the working point is moved to the side having a higher pressure ratio than the rated point when the load is high, separation of the air flow near the portion at 50% Ht (mid-span portion) is prevented, and lowering of the surge resistant property is prevented.

Since the stator blade 60 according to this embodiment is manufactured by paring the leading edge and the trailing edge (that is, it is not manufactured so as to add the tip portion, the mid-span portion and the root portion on the upstream side and/or the downstream side), upsizing in the axial direction is avoided.

In the compressing unit 20 provided with the stator blades 60 according to this embodiment, improvement of the performance is achieved, and improvement of the surge margin is achieved.

Figure 5:
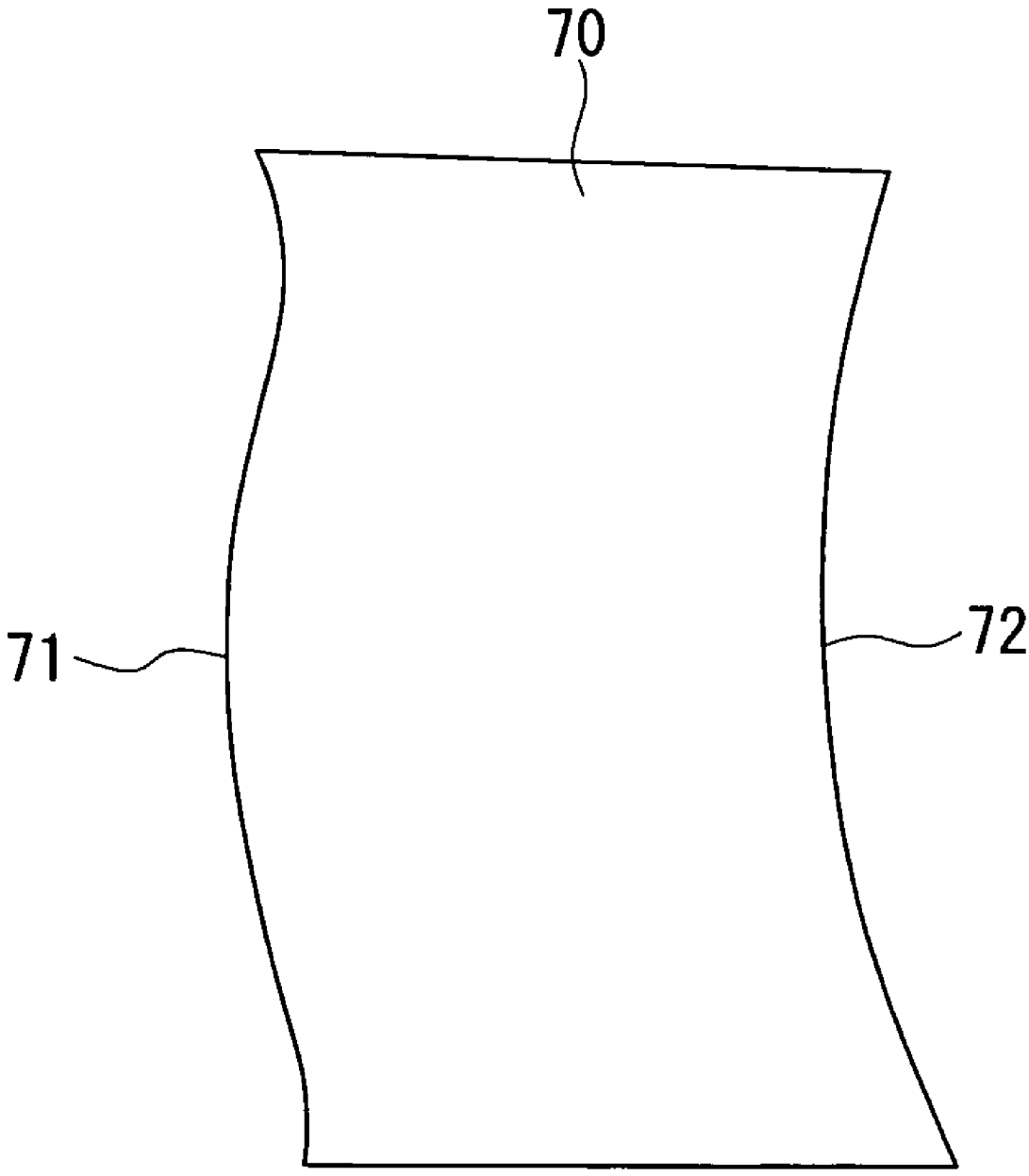
FIG. 5 is a drawing showing a second embodiment of an axial-flow fluid machine blade according to the present invention which is similar to FIG. 3.

Referring now to FIG. 5, a second embodiment of the stator blade in the present invention will be described.

A stator blade 70 in this embodiment is different from that in the first embodiment in that a leading edge 71 is formed so as to assume a substantially W-shape in plan view and a trailing edge 72 is formed so as to assume a substantially U-shape in plan view. Other components are the same as those in the first embodiment described above, and hence description of these components is omitted here.

As shown in FIG. 5, which is a similar drawing to FIG. 3, the leading edge 71 of the stator blade 70 is formed to assume a substantially W-shape in plan view in which the tip portion, the mid-span portion and the root portion project toward the upstream side (the upstream side with respect to the flow of combustion air). The trailing edge 72 of the stator blade 70 is formed so as to assume a substantially U-shape in plan view in which the tip portion and the root portion project toward the downstream side (the downstream side with respect to the flow of combustion air). In other words, the stator blade 70 is manufactured in such a manner that the chord length near a portion at 20% Ht and the chord length near a portion at 80% Ht is shorter than the chord length near a portion at 50% Ht (in other words, in such a manner that the chord length near the portion at 20% Ht and the chord length near the portion at 80% Ht are minimized).

The chord length near the portion at 50% Ht is the same as the chord length near a portion at 0% Ht and the chord length near a portion at 100% Ht.

The portion at 0% Ht corresponds to the root of the stator blade 70 and the portion at 100% Ht corresponds to the distal end of the stator blade 70.

The effects and advantages are the same as those in the first embodiment described above, and hence description thereof is omitted here.

The stator blades 60, 70 are preferably specifically when it is used in a subsonic state.

In the embodiments described above, the stator blade is manufactured in such a manner that the chord length near a portion at 20% Ht and the chord length near a portion at 80% Ht is shorter than the chord length near a portion at 50% Ht (in other words, in such a manner that the chord length near the portion at 20% Ht and the chord length near the portion at 80% Ht are minimized). However, the present invention is not limited thereto, and for example, may be manufactured in such a manner that the chord length near a portion at 25% Ht and the chord length near a portion at 75% Ht is shorter than the chord length near a portion at 50% Ht. The point relating to the chord length such that the chord length of this part is set to be shorter than the chord length of that part is a matter to be changed as needed.

The invention claimed is:

1. An axial-flow fluid machine blade used for an axial-flow fluid machine, comprising:

a leading edge projecting at a tip portion and a root portion thereof toward an upstream side; and a trailing edge projecting at the tip portion, a mid-span portion and the root portion thereof toward a downstream side, wherein the axial-flow fluid machine blade is formed in such a manner that a chord length at the tip portion is same as a chord length at the root portion.

2. An axial-flow fluid machine blade used for an axial-flow fluid machine comprising: a leading edge projecting at a tip portion, a mid-span portion and a root portion thereof toward an upstream side; and a trailing edge projecting at the tip portion and the root portion thereof toward a downstream side, wherein the axial-flow fluid machine blade is formed in such a manner that a chord length of the mid-span area is longer than a chord length of the area between the tip portion and the mid-span portion and the area between the mid-span portion and the root portion.

3. An axial-flow fluid machine blade used for an axial-flow fluid machine, wherein a chord length of the axial-flow fluid machine blade near a portion at 20% Ht and a chord length of the axial-flow fluid machine blade near a portion at 80% Ht are shorter than a chord length of the axial-flow fluid machine blade near a portion at 50% Ht, a chord length of the axial-flow fluid machine blade at 0%, and a chord length of the axial-flow fluid machine blade at 100%, when a root is at 0% Ht and a tip is at 100% Ht as a blade height.

4. An axial-flow fluid machine comprising the axial-flow fluid machine blade according to claim 1.

5. An axial-flow fluid machine comprising the axial-flow fluid machine blade according to claim 2.

6. An axial-flow fluid machine comprising the axial-flow fluid machine blade according to claim 3.

* * * * *